US005906972A

United States Patent [19]

Gabriel et al.

[11] Patent Number: 5,906,972

[45] **Date of Patent: *May 25, 1999**

[54] LIQUID DETERGENT COMPOSITION

[75] Inventors: Gladys Saliba Gabriel, Cranbury; Ronald B. Bell, Plainsboro; Mark Einziger, Manalapan, all of N.J.

[73] Assignee: Rhodia Inc., Cranbury, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/664,624

[22] Filed: Jun. 11, 1996

Related U.S. Application Data

[63] Continuation of application No. 08/323,246, Oct. 14, 1994, abandoned.

[51] Int. Cl.[6] ..... C11D 1/88; C11D 1/94; C11D 1/29; C11D 1/52

[52] U.S. Cl. ..... 510/499; 510/230; 510/223; 510/492

[58] Field of Search ..... 510/499, 230, 510/223, 492

[56] References Cited

U.S. PATENT DOCUMENTS

| | | | |
|---|---|---|---|
| 3,032,506 | 5/1962 | Brown | 510/223 |
| 4,671,894 | 6/1987 | Lamb et al. | 252/545 |
| 4,705,893 | 11/1987 | Sotoya et al. | 562/564 |
| 4,885,112 | 12/1989 | Sotoya et al. | 252/352 |
| 5,049,315 | 9/1991 | Hitz et al. | 510/223 |
| 5,089,163 | 2/1992 | Aronson et al. . | |
| 5,244,593 | 9/1993 | Roseele et al. | 510/230 |
| 5,340,502 | 8/1994 | Palicka | 252/546 |
| 5,409,640 | 4/1995 | Giret et al. | 252/546 |
| 5,744,063 | 4/1998 | Desai et al. | 252/356 |

FOREIGN PATENT DOCUMENTS

| | | |
|---|---|---|
| 0560519 | 9/1993 | European Pat. Off. . |
| 60-168796 | 9/1985 | Japan . |

OTHER PUBLICATIONS

Grant et al., Grant & Hackh's Chemical Dictionary, Fifth Edition, p. 230, 1987 (No Month Available).

*Primary Examiner*—Margaret Medley
*Attorney, Agent, or Firm*—John Daniel Wood; Craig M. Bell; Paul J. Juettner

[57] ABSTRACT

Novel liquid detergent compositions are provided which contain a high purity amphoteric surfactant, one or more anionic surfactants and a nonionic foam boosting compound.

23 Claims, No Drawings

LIQUID DETERGENT COMPOSITION

This application is a continuation of application Ser. No. 08,323,246, filed Oct. 14, 1994, now abandoned.

BACKGROUND OF THE INVENTION

1. Field of the Invention

The present disclosure relates to novel liquid detergent compositions. More specifically, this disclosure relates to detergent compositions wherein certain types of surfactants are combined with water and other optional additives to produce a final liquid which can be used as a manual dishwashing detergent having improved foam stability and grease cutting ability.

2. Technology Description

Liquid cleaning preparations generally consist of aqueous solutions of surfactants and additives. They are used in particular for cleaning hard surfaces, for example, glass, ceramic materials, plastics, painted and polished surfaces. One important application for liquid cleaning preparations is liquid cleaning compositions for manual washing of dishes, e.g., plates, utensils, crockery, pots and pans. Manual dishwashing is normally carried out at moderately elevated temperatures of from about 35° to 45° C. in highly dilute cleaning solutions. The detergent power of a cleaning preparation is generally judged by the user to be better, the longer the suds or foam remains. Grease cutting ability is another basis for evaluating the efficacy of a liquid cleaning preparation. Because the hands remain in contact with the washing suds for a prolonged period, the compatibility of the detergent with the skin is a particularly important factor in manual dishwashing. For these reasons, the artisan will be guided in the choice of the components and composition of a manual dishwashing detergent by other considerations than for liquid cleaning preparations for other hard surfaces.

Ongoing research toward developing improved liquid detergent compositions suitable for manual dishwashing has led to compositions containing a variety of materials intended to impart or enhance one or more desirable property of the detergent composition. Examples of materials included in liquid dishwashing detergents include, for example: various amounts of magnesium ions or other divalent ions (See, e.g., U.S. Pat. Nos. 4,316,824; 4,435,317; 4,823,635; 5,096,622; and 5,269,974); a combination of a water-soluble paraffin monosulfonate salt and a corresponding water-soluble salt of a disulfonate (See, e.g., U.S. Pat. No. 4,102,826); sulfonate dialkyl tetraline (See, e.g., U.S. Pat. No. 4,235,758); dialkyl ester of sulfosuccinic acid (See, e.g., U.S. Pat. Nos. 4,596,672 and 4,680,143); certain betaines (See, e.g., U.S. Pat. No. 4,671,894 and 4,681,704); fatty alkylmonoglucoside (See, e.g., U.S. Pat. No. 4,732,704); a combination of a 20 cationic surfactant and a water soluble $C_{21}$ dicarboxylic salt (See, e.g., U.S. Pat. No. 4,853,147); amine oxide or amidoamine oxide (See, e.g., U.S. Pat. Nos. 5,238,609 and 5,298,195); and a combination of three different types of amphoteric compounds (See, e.g., U.S. Pat. No. 5,340,502).

There exists a need for a liquid detergent suitable for manual dishwashing which is easy and inexpensive to manufacture, is stable, has superior grease cutting ability, provides long-lasting suds, is environmentally safe and is mild for human skin contact.

SUMMARY OF THE INVENTION

The novel detergent compositions in accordance with this disclosure include: (i) one or more anionic surfactants at least one of which is an ether sulfate, and (ii) a high purity amphoteric compounds of the formula:

$$R—C(O)—N(H)—CH_2CH_2—N—((CH_2)_yX)—(CH_2)_zCOOM$$

wherein R represents aliphatic radicals containing from about 5 to about 19 inclusive carbon atoms, Y is an number of from 2 to 4 inclusive, Z is 1, X is OH or $NH_2$ and M is a metal, said composition containing less than about 4.5% unalkylated amide, a glycolic acid content of less than about 5.5% and an alkali metal salt content of less than about 27%, each percentage being by weight based on the active weight of the amphoteric surfactant.

Optionally the present compositions include a nonionic foam boosting surfactant. In preferred embodiments, the nonionic foam boosting surfactant is an alkyl amide of the formula:

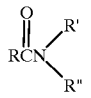

wherein R is a fatty alkyl group and R' and R" are the same or different and are individually selected from the group consisting of —H, $—CH_2CH(CH_3)OH$, $—(CH_2CH_2O)_xH$, and

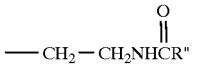

wherein X is a number from 1 to 20 and R" is a fatty alkyl group. In other preferred embodiments, the detergent compositions contain at least two different anionic surfactants, with at least one of the anionic detergents being in the form of an ammonium salt and another of the anionic detergents being an alkali metal salt.

In a particularly useful embodiment, the present disclosure relates to a detergent composition suitable for hand or manual dishwashing comprising an aqueous solution containing a combination of surfactants comprising: a) at least one salt of an aromatic anionic compound; b) at least one metal salt of an alkyl anionic compound; c) at least one ammonium salt of an ethoxylated and sulfated alcohol; d) a high purity amphoteric compound as defined herein; and e) a nonionic foam boosting alkylamide compound.

Preferably, the liquid detergent compositions comprise a mixture of surfactants, comprising:

(i) between 1 and 20 active weight percent of one or more of the high purity amphoteric surfactants;

(ii) between 1 and 60 active weight percent of one or more of the anionic surfactants; and (iii) up to 25 active weight percent of one or more of the nonionic foam boosting surfactants;

the active percent being from 20 to 95 percent of the total surfactant load or the total surfactant in the composition.

In yet another aspect, the present invention relates to a novel process for preparing a liquid detergent composition by a) preparing a concentrated aqueous solution containing a mixture of surfactants as defined herein; and b) diluting the concentrated aqueous solution at a temperature not substantially greater than room temperature to provide a homogeneous, clear, shelf-stable liquid detergent composition.

Also, the compositions of the present disclosure are sufficiently mild that lower chain length anionic surfactant known to have irritating qualities can be effectively used in a mild formulation.

DETAILED DESCRIPTION OF PREFERRED EMBODIMENTS

In describing the preferred embodiments, certain terminology will be utilized for the sake of clarity. Such terminology is intended to encompass the recited embodiment, as well as all technical equivalents which operate in a similar manner for a similar purpose to achieve a similar result.

The present invention utilizes amphoteric surfactant(s) of defined purity and anionic surfactant(s) in an aqueous liquid to produce a liquid detergent composition which has excellent foaming and grease cutting properties. In the preferred embodiment, the amount of combined surfactant is between 20 and 95 active percent of the total surfactant load. The 20 to 95 active weight percent of the formulation includes between about 1 and about 20 parts active amphoteric surfactant as defined herein, between about 1 and about 60 parts active anionic surfactant and between about 1 and about 25 parts active nonionic foam boosting surfactant.

The present liquid detergent compositions include one or more primary surfactants to provide foaming and grease cutting and a foam stabilizing amount of one or more amphoteric and, optionally nonionic surfactants.

In particularly useful embodiments, one or more anionic surfactant wherein at least one is an ether sulfate is chosen to serve as the primary surfactant. The anionic surfactant(s) chosen with the exception of the ether sulfate is not critical and may be any of the known anionic surfactants and is chosen on the basis of compatibility, effectiveness and economy. These anionic surfactants include any of the known hydrophobes attached to a carboxylate, sulfonate, sulfate or phosphate polar, solubilizing group including salts. Salts may be the sodium, potassium, ammonium and amine salts of such surfactants.

Examples of such anionic surfactants include water soluble salts of alkyl benzene sulfonates having between 6 and 22 carbon atoms in the alkyl group, alkyl and aryl ether sulfates having between 6 and 22 carbon atoms in the alkyl or aryl group, alkali metal, ammonium and alkanolammonium salts or organic sulfuric reaction products having in their molecular structure an alkyl or alkaryl group containing from 6 to 22 carbon atoms and a sulfonic or sulfuric acid ester group.

Particularly preferred are linear alkali metal, e.g., sodium, and ammonium alkyl ether sulfates that are synthesized by sulfating a higher alcohol having between 6 and 18 carbon atoms and ethoxylated with 2 to 9 moles of ethylene oxide. Another preferred anionic surfactant is alkyl benzene sulfonate, in which the alkyl group contains between about 9 to about 15, and even more preferably, between about 11 to about 13 carbon atoms in a straight chain or branched chain configuration and even most preferred a linear straight chain having an average alkyl group of about 11 carbon atoms. As used herein, alkyl is intended to include fatty alkyl groups from natural sources generally containing a wide range of chain lengths and those ranges are intended to be substantially included in any carbon chain range.

In particularly preferred embodiments, mixtures of anionic surfactants are utilized, with mixtures of alkyl ether sulfate and alkylaryl sulfonates being especially preferred. Such embodiments comprise a mixture of alkali metal salts, preferably sodium salts, of alkyl benzene sulfonates having from about 9 to 15, and more preferred between 11 and 13 carbon atoms with an alkali metal salt, preferably sodium, of an alkyl sulfate and alkyl ethoxy sulfate having 10 to 20 and preferably 12 to 18 carbon atoms and an average ethoxylation of 7 to 11.

In another particularly preferred embodiment, three different anionic surfactants are employed as the primary surfactant, namely: i) an alkylaryl sulfonate; ii) an alkali metal salt of an $C_6$–$C_{20}$ alkylethoxy sulfate having an average ethoxylation of 7 to 11; and iii) an ammonium salt of a $C_6$–$C_{20}$ alkyl ethoxy sulfate having an average ethoxylation of 1 to 4.

Specific anionic surfactants which may be selected as the linear alkyl benzene sulfonates can be illustrated by dodecylbenzene sulfonate, decylbenzene sulfonate, undecylbenzene sulfonate, tridecylbenzene sulfonate, nonylbenzene sulfonate and the sodium, potassium, ammonium, triethanolammonium and isopropylammonium salts thereof. A particularly preferred sulfonate salt is sodium dodecylbenzene sulfonate. Such chemicals are sold under the trade name Biosoft 100 by Stepan Chemicals of Northfield, Ill. Other anionic surfactants include polyethoxylated alcohol sulfates, such as those sold under the trade name Neodol 25-3S by Shell Chemical Company. Examples of other anionic surfactants are provided in U.S. Pat. No. 3,976,586, the disclosure of which is incorporated by reference.

In practice, the anionic portion comprises between 1 and 60 active parts of the liquid composition. In particularly preferred embodiments, the amount is between 15 and 45 active parts.

Detergent compositions in accordance with this disclosure also include a foam stabilizing amount of a high purity amphoteric surfactant alone or in combination with minor amounts of other amphoteric surfactants.

The particularly useful amphoteric surfactants for the invention include both mono and dicarboxylates, although the amount of dicarboxylates is less than 15% and preferably less than 10% by weight based on the weight of the mono and dicarboxylate. The mono-carboxylate can be represented by the formula:

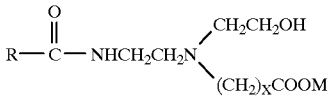

wherein R is an alkyl group of 6–20 carbon atoms, x is 1 or 2 and M is hydrogen or sodium.

The most preferred amphoteric surfactants are highly purity substituted imidazoline-derived amphoacetate surfactant compositions containing as the main component a compound of the formula:

$$R—C(O)—N(H)—CH_2CH_2—N—((CH_2)_yX)—(CH_2)_zCOOM$$

wherein R represents aliphatic radicals containing from about 5 to about 19 inclusive carbon atoms, Y is an number of from 2 to 4 inclusive, Z is 1, X is OH or $NH_2$ and M is a metal, said composition containing less than about 4.5% unalkylated amide, a glycolic acid content of less than about 5.5% and a alkali metal salt content of less than about 27%, each percentage being by weight based on the active weight of the amphoteric surfactant. Such high purity surfactants are commercially available under the tradenames MIRANOL ULTRA C-32 and MIRAPON EXCEL 825, both available from Rhone-Poulenc, Inc. Cranbury, N.J.

To prepare the preferred high purity amphoteric surfactants, an imidazoline is heated with a salt of a monohaloacetate. The haloacetate salt is preferably in aqueous solution prior to admixture with the imidazoline. A convenient method for accomplishing that is to prepare the salt from the acid just prior to the reaction. An advantage to this procedure is that the salt can be prepared with an excess of base to provide neutralization for the hydrohalic acid formed during the reaction of the imidazoline with the haloacetate salt. The excess pH preferably ranges from about 8 to about 10. Of course, haloacetate salt can be purchased or prepared elsewhere, dissolved in water and used as such or preferably with an added amount of base corresponding to the excess discussed above.

The mole ratio of the monohaloacetic acid or its salt form to the imidazoline or amine is preferably greater than one. At amounts of less than one, insufficient monohaloacetic acid salts are present to effect complete alkylation leaving the product contaminated with the amido amine which has no surface activity. If too high a ratio is used, the product will contain excess glycolic acid since the monohaloacetate salt will react with the base to convert that reactant to glycolic acid. Surprisingly, the ratio can be kept as low as possible with only a slight excess needed to drive the reaction to completion while still achieving substantially full alkylation. It is possible to keep the ratio as low as 1.05:1. Preferably the ratio ranges from about 1.05:1 to about 1.5:1, more preferably 1.05:1 to about 1.4:1 and most preferably 1.05:1 to abut 1.2:1.

The reaction is generally conducted at a temperature conducive to the reaction as is well known in the industry. Reaction temperatures for the main reaction can range as high as 95° C., preferably between abut 50° C. and about 95° C. Preferably, the temperature ranges from about 75° to about 85° C. The reaction can be heated after the main reaction is considered complete to insure completeness of reaction. Temperatures during this portion of the reaction can range as high at 100° C.

The reaction times are sufficient to accomplish each desired reaction step and can be easily determined by a skilled artisan.

In general, the monohaloacetic acid or salt is blended with the imidazoline at a rate as fast as possible and practical to admix the reactants completely. Because pH control is essential the reactants, especially the base, are added at such a rate as to prevent pH rises above about pH 10. Care is taken to avoid localized "hot spots" during the addition of base. The base is added incrementally to avoid any pH surge.

The careful pH and temperature control during the reaction allows the reaction to proceed with less sodium monohaloacetate salt resulting in a higher purity product (less by-product unalkylated amide, glycolic acid, NaCl and residue haloacetate salt). The compositions are characterized by levels of unalkylated amide of less than about 4.5%, preferably less than about 2.0% and more preferably less than about 0.5% unalkylated amide on an actives basis. The compositions are also characterized by levels of glycolic acid of less than about 5.5%, preferably less than about 3.5% and more preferably less than about 2.5% glycolic acid on an actives basis. The compositions are further characterized by levels of alkali metal salt, e.g., sodium chloride, of less than about 27%, preferably less than about 23% and more preferably less than about 20% salt on an actives basis. A particularly preferred high purity amphoteric surfactant composition has an unalkylated amide content ranging from about 4.5% to about 1%, a glycolate content ranging from about 5.5% to about 1.5%, and a salt content ranging from about 27% to about 15%.

In practice, the amphoteric surfactant comprises between 1 and 20 active parts of the liquid composition. In particularly preferred embodiments, the amount is between 5 and 15 active parts, and in even more preferred embodiments, the amount ranges between about 8 and about 13 active parts.

Other amphoteric surfactants which may be present in minor amounts can be illustrated by the alkali metal, alkaline earth metal, ammonium or substituted ammonium salts of alkyl amphocarboxy glycinates and alkyl amphocarboxypropionates, alkyl amphodipropionates, alkyl amphodiacetates, alkyl amphoglycinates and alkyl amphopropionates wherein alkyl represents an alkyl group having 6 to 20 carbon atoms. Other suitable amphoteric surfactants include alkyliminopropionates, alkyl iminodipropionates and alkyl amphopropylsulfonates having between 12 and 18 carbon atoms, alkylbetaines and amidopropylbetaines and alkylsultaines and alkylamidopropylhydroxy sultaines wherein alkyl represents an alkyl group having 6 to 20 carbon atoms. Each of these types of amphoteric surfactants are known to those skilled in the art and are commercially available from a variety of sources. With respect to the additional amphoteric surfactant, the term "minor amount" is intended to mean 10% on an active basis based on the total actives in the composition.

As used herein, the term "ampho" such as part of the compound "amphodiacetate" is intended to designate a structure of the formula

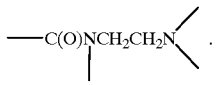

A non-ionic surfactant may be used in combination with the amphoteric surfactant to provide foam stabilization. The particular nonionic surfactant(s) selected is not critical and may be any of the known nonionic surfactants and is selected on the basis of compatibility, effectiveness and economy, though alkanolamides are most preferred.

Examples of useful nonionic surfactants include condensates of ethylene oxide with a hydrophobic moiety which has an average hydrophilic lipophilic balance (HLB) between about 8 to about 16, and more preferably, between about 10 and about 12.5. These surfactants include the condensation products of primary or secondary aliphatic alcohols having from about 8 to about 24 carbon atoms, in either straight or branched chain configuration, with from about 2 to about 40, and preferably between about 2 and about 9 moles of ethylene oxide per mole of alcohol. Such materials are commercially sold under the trade name Neodol 25-9, Neodol 25-6.5 and Neodol 25-7 sold by Shell Chemical Company.

Other suitable nonionic surfactants include the condensation products of about 6 to about 12 carbon atom alkyl phenols with about 3 to about 30, and preferably between about 5 and about 14 moles of ethylene oxide. Examples of such surfactants are sold under the tradenames Igepal CO 530, Igepal CO 630, Igepal CO 720 and Igepal CO 730 by Rhone-Poulenc Inc. Still other suitable nonionic surfactants are described in U.S. Pat. No. 3,976,586, the disclosure of which is incorporated herein by reference.

Particularly preferred nonionic surfactants are non-ionic amides including alkanolamides, ethoxylated alkanolamides, and ethylene bisamides with alkanolamides being most preferred. Alkanolamides have the general formula:

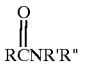

wherein R is a fatty alkyl group and R' and R" are the same or different and are individually selected from the group consisting of —H,—CH2CH2OH and —CH2CH(CH3)OH. Alkanol amides having $C_8$–$C_{18}$ fatty alkyl groups are preferred such as, for example coco-, lauric, myristic, linoleic or stearic groups. Cocodiethanolamide is the most preferred nonionic surfactant to be employed in compositions in accordance with this invention.

In practice, the nonionic portion comprises between 1 and 25 active parts based on the total surfactant load in the composition. In particularly preferred embodiments, the amount is between 5 and 20 active parts, and in even more preferred embodiments, the amount ranges between about 6 and about 12 active parts.

The present liquid detergent compositions preferably contains anionic surfactant(s), a high purity amphoteric surfactant composition and a nonionic foam boosting surfactant where the ratio of anionic primary surfactant to high purity amphoteric surfactant to nonionic foam boosting surfactant ranges from about 3:1:1 to about 9:1:1 and more preferably from about 4:1:1 to 7:1:2.

The described liquid detergent compositions are essentially unbuilt liquids, i.e., do not contain proportions of organic or inorganic builder salt in the detergent building proportions, and, therefore, are particularly suitable for use as liquid, hand dishwashing detergents, though a small amount of builder could be added for metal ion sensitivity. Thus, the present compositions can contain any of the usual adjuvants found in those compositions provided that they do not interfere with the performance properties of the inventive liquids. For example, liquid detergent compositions generally need to contain one or more hydrotropes. These are materials present in a formulation to control solubility, viscosity, clarity and stability, but which themselves make no active contribution to the performance of the product. Examples of hydrotropes include one or more lower aliphatic alcohols, such as $C_1$–$C_3$ lower alkyl alcohols, especially ethanol, as well as fatty alcohols such as $C_8$ to $C_{20}$; and particularly mixtures of lower aliphatic alcohols, e.g., $C_1$–$C_3$ lower alkyl alcohols, and fatty alcohols; urea; lower alkylbenzene sulphonates such as sodium toluene or xylene sulphonates; and combinations of these. Hydrotropes should be used in the minimum possible quantities consistent with good formulation properties over a wide temperature range. Other additional ingredients include minor proportions of perfumes and colors for aesthetic purpose, opacifiers such as ethylene glycol distearate or polystyrene, thickening agents such as natural gums or hydroxypropyl methyl cellulose, sequestering agents such as citrate or ethylene diamine tetraacetate, preservatives such as formaldehyde or Dowicil® 200 or monomethyloldimethyl hydantoin, non-tarnishing agents, spot prevention agents, odor absorbing ingredients such as sodium bicarbonate, antimicrobial agents, and inert salts such as sodium sulfate or sodium chloride. The total concentration of added ingredients usually will be less than 5%, preferably less than 3%, by weight of the total composition.

Generally, the viscosity of the liquid compositions will be within the range of about 20 centipoises (cps) to 2000 cps., and preferably from 75 cps. to 1500 cps. Viscosity is measured using a Brookfield Viscometer, Model RV, with a #3 spindle rotating at 100 r.p.m. The most preferred viscosity range is 150 cps. to 1200 cps. based upon current consumer preferences. However, it will be recognized by one skilled in the art that liquids of even higher viscosity can be achieved by including up to 2% by weight of a known thickening agent in the compositions.

Generally, these liquid compositions are prepared by admixing the individual detergent ingredients with the formula weight of water with agitation at a temperature in the range of about 20° C. to 65° C. Usually, the individual detergents are added in the form of aqueous solutions or dispersions of the anionic detergent salts. Typically, the amphoteric surfactant is added in liquid form as one of the last ingredients. Additionally, it is desirable to add any solubilizing agent to the formula weight of water prior to the additional of the essential anionic detergent ingredients in order to avoid formation of gels. Any additional ingredients, such as color and perfume usually are added with agitation after the surfactants while cooling the mixture to a temperature of 20° C. to 32° C. The pH is usually adjusted, if necessary, to a pH in the range of 5–8, preferably 6.5–7.5, for dishwashing products by addition, for example, of either sulfuric acid or citric acid or sodium hydroxide, potassium hydroxide or triethanolamine. Further, any adjustment of viscosity may be achieved by adding additional amounts of the appropriate solubilizers or thickening agents.

It is a surprising and unexpected advantage of the particularly preferred compositions disclosed herein that they can be combined to form a concentrate at temperatures not substantially exceeding room temperature and further that the concentrates can be let down, i.e., diluted, with instant solubility at room temperature to finished consumer products which are clear, homogeneous and shelf-stable at temperatures not substantially exceeding room temperature. By the phrase "temperatures not substantially exceeding room temperatures", it is meant temperatures below about 27° C. This constitutes a significant processing advantage over prior detergent compositions which frequently require elevated temperatures during processing, particularly during let down.

The invention is described in greater detail by the following non-limiting examples.

EXAMPLE 1

This example illustrates the process of preparing a preferred high purity amphoteric surfactant composition used in the present detergent compositions.

To a reaction vessel is added 20.57 parts water, 0.07 parts ethylenediaminetetraacetic acid, 11.92 parts monochloroacetic acid (99+%) and 20.93 parts of ice. To the reactor is then slowly added with cooling 12.5 parts of 50% sodium hydroxide solution. The temperature is maintained at from 35° C. to 40° C. during the caustic addition.

Coco imidazoline (equivalent weight of about 270) which has been premelted at a temperature of from 65° to 70° C. in an amount of 28.78 parts is added to the reaction vessel as fast as possible. The temperature is kept below 50° C. during the addition which is completed in 20 minutes. The reaction mixture goes through a gel phase before becoming a clear liquid. Reaction temperature is maintained at 50° C. for 2 hours after coco imidazoline addition is complete. The temperature is then raised to 75° C. and caustic is added in three steps.

Specifically, 1.93 parts of a 50% sodium hydroxide solution is charged and the reaction mixture held for 15 minutes at 75° C. An additional 1.93 is charged and held for 15 minutes at 75° C. and then 1.43 parts of 50% sodium hydroxide are charged. The pH after these additions was 9.3. The reaction mixture is held at 75° C. for an additional 3 hours. During this time, the reaction pH is determined every 30 minutes. If the pH is less than 8.5, additional sodium hydroxide is added to elevate the pH to 9.5. After 3 hours, the chloride level is determined, i.e., inorganic chloride divided by the amount of chloride present in the reactants. The ratio is determined by measuring the chloride content in a sample followed by boiling the sample in caustic to liberate any organically bound chloride, thus determining the total chlorine present in the sample. If the chloride ratio is 0.99, or above, the reaction is considered completed and the mixture is additionally heated to 90° to 95° C. for 2 hours. After rechecking the chloride ratio, the product is cooled to 60° C. and sufficient water is charged to a solids content of 44% to 45%.

In the examples that follow, the grease cutting and foam stability of the detergent formulations were tested using the methodology set forth in ASTM D4009-81. In summary, a soil prepared from flour, shortening and oleic acid is applied in a standard manner to a stack of twenty plates. A 0.1% solution of formulation to be tested is prepared in a basin and the dishes are washed one at a time following a predetermined procedure. Foam stability is determined by the number of plates washed before half of the water surface is no longer covered with suds. Grease cutting ability is determined by the number of plates which can be cleaned of the soil to the extent that the dish squeaks when a finger is run over its clean surface.

EXAMPLE 2

To show the superior effects provided by the surfactant combinations disclosed herein, a series of experiments were conducted using simplified surfactant systems. In each simplified system, the test formulation included 30% actives with set ratios for the ingredients. The ingredients used to prepare the test formulations included one or more of:

AMPHOTERIC SURFACTANT
- A—high purity cocoamphoacetate

ANIONIC SURFACTANTS
- B—sodium salt of a linear ether sulfate
- C—ammonium salt of a linear ether sulfate
- D—sodium salt of an aromatic ether sulfate
- E—ammonium salt of an aromatic ether sulfate NONIONIC SURFACTANT
- F—cocodialkanolamide The ratio of anionic surfactant to amphoteric surfactant in each test formulation which includes those ingredients is 7:1 and the ratio of anionic surfactant to nonionic surfactant in each test formulation which includes those ingredients is 7:1.6. Where all three types of materials are included in the test formulation the ratio of anionic surfactant to amphoteric surfactant to nonionic surfactant is 7:1:1.6. Where two anionic surfactants were included in the test formulation, equal parts of each anionic surfactant were used. The results of the tests for grease cutting ability and foam stability are reported in Table 1 as #plates/#plates with the first number reflecting grease cutting and the second number reflecting foam stability.

TABLE 1

| ANIONIC SURFACTANT(S) ALONE | AMPHOTERIC ANIONIC SURFACTANTS | NONIONIC ANIONIC SURFACTANTS | AMPHOTERIC NONIONIC ANIONIC SURFACTANTS |
|---|---|---|---|
| B: 5/5 | A + B: 7/7 | F + B: 6/6 | A + F + B: 8/8 |
| C: 5/5 | A + C: 7/7 | F + C: 6/6 | A + F + C: 8/8 |
| D: 4/4 | A + D: 5/5 | F + D: 5/5 | A + F + D: 7/9 |
| E: 4/4 | A + E: 5/5 | F + E: 6/6 | A + F + E: 8/8 |
| B + C: 4/4 | A + B + C: 6/6 | F + B + C: 6/6 | A + F + B + C: 8/8 |
| B + D: 1/2 | A + B + D: 6/6 | F + B + D: 5/5 | A + F + B + D: 6/6 |
| B + E: 2/2 | A + B + E: 6/6 | F + B + E: 5/5 | A + F + B + E: 6/6 |
| C + D: 2/2 | A + C + D: 5/5 | F + C + D: 6/6 | A + F + C + D: 6/6 |
| C + E: 2/3 | A + C + E: 6/6 | F + C + E: 6/6 | A + F + C + E: 6/6 |
| D + E: 2/2 | A + D + E: 4/4 | — | A + F + D + E: 5/5 |

As the data in Table 1 show, the addition of either a nonionic or amphoteric surfactant improved the effectiveness of the anionic surfactant(s). The improvement as most dramatic where a combination of alkyl ether sulfate and aromatic ether sulfate anionic surfactants was employed. In another aspect, the effectiveness of the anionic surfactants as surprisingly improved where a combination of amphoteric and nonionic surfactants were used together with one or more anionic surfactants.

The amphoteric and nonionic components of a liquid dishwashing detergent are generally the most costly surfactant ingredients in the formulation. When tested alone, the high purity amphoteric and the nonionic surfactants each achieved a 7/7 score. Thus, the present detergent compositions are extremely advantageous from an economical perspective since only a small amount of the amphoteric and/or nonionic surfactant need be combined with the primary surfactant to achieve excellent foam stability and grease cutting.

EXAMPLE 3

A liquid detergent is prepared having the following formulation:

| Ingredient | W/W % |
|---|---|
| Sodium Cocoamphoacetate (See Example 1) | 13.50 |
| Ammonium Salt of Nonylphenol Ether Sulfate | 16.20 |
| Cocamide DEA/DEA | 8.00 |
| Sodium Lauryl Ether Sulfate (9 moles EO) | 28.37 |
| Sodium $C_8$–$C_{10}$ Alkyl Ether Sulfate | 24.28 |
| Sodium Xylene sulfonate | 5.00 |
| Ethanol-190 Proof | 3.80 |
| Citric Acid | 0.85 |

The above formulation is prepared as follows: Into a clean mixing vessel is first added to the amphoteric surfactant. The following ingredients are then added sequentially to the vessel with mixing: sodium $C_8$–$C_{10}$ alkyl ether sulfate; the ammonium aromatic ether sulfate; the amide; the xylene sulfonate; the non-ionic surfactant and ethanol. Mixing is continued until a clear, homogenous solution is obtained. Citric acid is then added to the vessel. The mixture is sampled and pH of the mixture is adjusted to 6.9–7.2 by the addition of either citric acid or a 30% solution of ammonium hydroxide. The remaining anionic surfactant is then charged to the vessel and mixing is continued to produce a homogenous clear yellow liquid.

The foam stability of the formulation of Example 3 at 35% solids let down as tested using the above-described ASTM method is 16 plates and the grease cutting ability is 16 plates. For comparison purposes, the foam stability and grease cutting ability of a commercially available dishwashing detergent (DAWN) is determined to be 13 and 10 plates, respectively, using the same technique.

EXAMPLE 4

A liquid detergent is prepared having the following formulations:

| Ingredient | W/W % |
|---|---|
| Deionized Water | 6.30 |
| Sodium Hydroxide | 3.50 |
| Dodecyl benzene sulfonic acid | 9.54 |
| Sodium Xylene Sulfonate | 7.50 |
| Ethanol 190 proof | 3.80 |
| $C_{12}$–$C_{15}$ Alcohol Alkylether sulfate | 30.43 |
| Lauryl fatty alcohol | 1.68 |
| Cocamide DEA/DEA | 8.00 |
| Ammonium salt of ethoxylated and sulfated $C_8$–$C_{10}$ alcohol | 15.75 |
| Sodium Cocamphoacetate (See Example 1) | 13.50 |

The above formulation is prepared as follows: The water is added to a previously cleaned mixing vessel. Sodium hydroxide solution is added to the vessel, and while agitating the dodecyl benzene sulfonic acid is slowly added to the vessel. The temperature of the mixture is then lowered to about 20° C. and the sodium xylene sulfonate is charged to the vessel. Ethanol is then added to the vessel while maintaining the temperature of the vessel at around 20° C. While mixing, the following materials are sequentially added to the vessel: sodium alkyl ether sulfate; lauryl alcohol; alkanolamide; the ammonium alkylether sulfate and the amphoteric surfactant. Mixing is continued until a homogeneous mixture is obtained. The mixture is sampled and the pH of the mixture is adjusted to 6.9–7.3 by the addition of either sulfuric acid or sodium hydroxide with mixing. The resulting product is a clear pale yellow liquid.

The foam stability of the formulation of Example 3 at 30% solids let down as tested using the above described ASTM method is 20+ plates and the grease cutting ability is 17 plates.

Various additives can be added during let down of the formulation of Example 4 including, but not limited to, perfume, dye, thickener (e.g., a guar derivative in an appropriate acidic aqueous solution) and functional ingredients (e.g., antimicrobial). The composition of Example 4 also provides the advantage that a consumer product can be attained by let down at ambient temperatures.

Having described the invention in detail and by reference to the preferred embodiments thereof, it will be apparent that modifications and variations are possible without departing from the scope of the appended claims.

What is claimed is:

1. A detergent composition comprising:

a) a high purity amphoteric surfactant composition containing as main component a compound of the formula:

$$R—C(O)—N(H)—CH_2CH_2—N—((CH_2)_yX)—(CH_2)_zCOOM$$

wherein R represents aliphatic radicals containing from about 5 to about 19 inclusive carbon atoms, Y is a number of from 2 to 4 inclusive, Z is 1, X is OH or $NH_2$ and M is a metal, said composition having an unalkylated amide content ranging from about 4.5% to about 1%, a glycolic acid content ranging from about 5.5% alkali metal to about 1.5% and a salt content ranging from about 27% to about 15%, each percentage being by weight based on the active weight of the amphoteric surfactant;

b) one or more anionic surfactants at least one of which is an ether sulfate, and c) at least one salt of an aromatic anionic compound.

2. A detergent composition suitable for hand dishwashing comprising an aqueous solution containing a combination of surfactants, the combination of surfactants comprising:

a) at least one salt of an aromatic anionic compound:

b) at least one metal salt of an alkyl anionic compounds;

c) at least one ammonium salt of an ethoxylated and sulfated alcohol;

d) a high purity amphoteric surfactant composition containing as the main component a compound of the formula:

$$R—C(O)—N(H)—CH_2CH_2—N—((CH_2)_yX)—(CH_2)_zCOOM$$

wherein R represents aliphatic radicals containing from about 5 to about 19 inclusive carbon atoms, Y is an number of from 2 to 4 inclusive, Z is 1, X is OH or $NH_2$ and M is a metal, said composition having an unalkylated amide content ranging from about 4.5% to about 1%, a glycolate content ranging from about 5.5% to about 1.5%, and a salt content ranging from about 27% to about 15%, each percentage being by weight based on the active weight of the amphoteric surfactant; and e) a nonionic amide compound.

3. A liquid detergent composition comprising a mixture of surfactants, said mixture comprising:

(I) between 1 and 20 active weight percent of one or more amphoteric surfactants, at least 75% of the amphoteric surfactant being provided as a high purity amphoteric surfactant composition containing as the main component a compound of the formula:

$$R—C(O)—N(H)—CH_2CH_2—N—((CH_2)_yX)—(CH_2)_zCOOM$$

wherein R represents aliphatic radicals containing from about 5 to about 19 inclusive carbon atoms, Y is a number of from about 2 to 4 inclusive, Z is 1, X is OH or $NH_2$ and M is a metal, said composition having an unalkylated amide content ranging from about 5.5% alkali metal to about 1.5% and a salt content ranging from about 27% to about 15%, each percentage being by weight based on the active weight of the amphoteric surfactant;

(ii) between 1 and 50 active weight percent of one or more anionic surfactants wherein at least one is an ether sulfate, and at least one is a salt of an aromatic anionic compound, and (iii) up to 25 active weight percent of one or more nonionic surfactants;

the sum of (i), (ii) and (iii) being between 20 and 80 active weight percent.

4. The composition according to claim 3 wherein said anionic surfactant is selected from the group consisting of water soluble salts of alkyl benzene sulfonates having between 6 and 22 carbon atoms in the alkyl group, alkyl ether sulfates having between 6 and 22 carbon atoms in the alkyl group, and alkali metal, ammonium and alkanolammonium salts or organic sulfuric reaction products having in their molecular structure an alkyl, or alkaryl group containing from 8 to 22 carbon atoms and a sulfonic or sulfuric acid ester group and mixtures thereof.

5. The composition according to claim 4 wherein said anionic surfactant is selected from the group consisting of linear sodium and potassium alkyl ether sulfates that are synthesized by sulfating a higher alcohol having between 8 and 18 carbon atoms and having 2 to 9 moles of ethylene oxide and alkyl benzene sulfonates, in which the alkyl group contains between about 9 to about 15 carbon atoms, and mixtures thereof.

6. A detergent composition as in claim 1 which further includes a nonionic amide compound of the formula

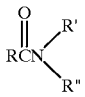

wherein R is a fatty alkyl group and R' and R" are the same or different and are individually selected from the group consisting of —H, —$CH_2CH(CH_3)OH$, —$(CH_2CH_2O)_xH$, and

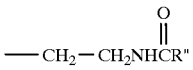

wherein X is a number from 1 to 20 and R" is a fatty alkyl group.

7. A composition as in claim 6, wherein R' and R" are the same and are —$CH_2CH_2OH$.

8. A detergent composition as in claim 1, which contains at least two different anionic surfactants.

9. A detergent composition as in claim 8, wherein at least one of the anionic detergents is in the form of an ammonium salt and another of the anionic detergents is an alkali metal salt.

10. A detergent composition as in claim 1, wherein the ratio of anionic surfactant to amphoteric compound is in the range of from about 5:1 to about 10:1.

11. A detergent composition as in claim 6, wherein the ratio of anionic surfactant to nonionic compound is in the range of from about 5:1 to about 10:1.

12. A detergent composition as in claim 1, further comprising one or more alcohols.

13. A detergent composition as in claim 12, containing a combination of $C_1$–$C_3$ alkyl alcohol and a $C_8$–$C_{20}$ fatty alcohol.

14. A detergent composition as in claim 1, which is essentially free of alkaline earth metal ions.

15. A detergent composition as recited in claim, 1 wherein said amphoteric surfactant is prepared by reacting an alkylimidazoline or an open ring derivative thereof with a monohaloacetic acid or salt thereof in the presence of an alkali under conditions such that the pH of the reaction mixture during the react does not exceed pH 10, said amphoteric surfactant being an alkylated amphoteric containing mono and dialkylation and having less than about 15% dialkylated surfactant based on the weight of active in the surfactant.

16. A detergent composition as recited in claim 15 wherein the pH during the reaction is maintained at an amount within a pH range of from about 8.5 to about 9.5.

17. A detergent composition in claim 15 wherein the reaction is conducted at a temperature within the range of from about 75° to about 85° C.

18. A detergent composition as recited in claim 15 wherein the ratio of haloacetic acid or a salt thereof to alkylimidazoline ranges from about 1.05:1 to about 1.5:1.

19. A detergent composition as recited in claim 1 wherein said amphoteric surfactant is prepared by a process comprising:

a) reacting an alkylimidazoline with heat at a pH ranging from about 8.5 to about 9.5 to form an open ring derivative of said alkylimidazoline;

b) reacting said open ring derivative of said imidazoline with a monohaloacetic acid or a salt thereof in the presence of an alkali under conditions such that the pH of the reaction mixture during the reaction does not exceed a pH above about pH 10; and c) recovering said amphoteric surfactant, said amphoteric surfactant being an alkylated amphoteric containing mono and dialkylation and having less than about 15% dialkylated surfactant based on the weight of active in the surfactant.

20. A detergent composition as recited in claim 1 wherein said amphoteric surfactant is prepared by a process comprising:

a) reacting an alkylimidazoline with heat at a pH ranging from about 8.5 to about 9.5 for a period of time sufficient to open a majority of the alkylimidazoline rings, b) reacting the product of step a) with a monohaloacetic acid or a salt thereof in the presence of an alkali under conditions such that the pH of the reaction mixture during the reaction does not exceed a pH above about pH 10, the temperature of the reaction ranging from about 50° to abut 95° C., and c) recovering said amphoteric surfactant said amphoteric surfactant being an alkylated amphoteric containing mono and dialkylation and having less than about 15% dialkylated surfactant based on the weight of active in the surfactant.

21. The composition according to claim 3 wherein said anionic surfactant is a mixture of sodium dodecylbenzene sulfonate and polyethoxylated alcohol sulfates.

22. The composition according to claim 3 wherein said nonionic surfactant is selected from the group consisting of alkanolamides, ethoxylated alkanolamides and ethylene bisamides.

23. A process for preparing a liquid detergent composition comprising:

a) preparing a concentrated aqueous solution containing a mixture of surfactants by mixing two or more anionic surfactants at least one of which is an ether sulfate and at least one is a salt of an aromatic anionic compound with a foam stabilizing amount of a high purity amphoteric surfactant composition containing as the main component a compound of the formula $$R—C(O)—N(H)—CH_2CH_2—N—((CH_2)_yX)—(CH_2)_zCOOM$$

wherein R represents aliphatic radicals containing from about 5 to about 19 inclusive carbon atoms, Y is a number of from 2 to 4 inclusive, Z is 1, X is OH or $NH_2$ and M is a metal, said composition having an unalkylated amide content ranging from about 4.5% to about 1%, a glycolate content ranging from about 5.5% to about 1.5% and a salt content ranging from about 27% to about 15%, each percentage being by weight based on the active weight of the amphoteric surfactant, and optionally a nonionic alkamide compound, and b) diluting the concentrated aqueous solution at a temperature not substantially greater than room temperature to provide a homogeneous, clear, shelf-stable liquid detergent composition.

* * * * *